United States Patent [19]

Yoneyama

[11] Patent Number: 4,911,444

[45] Date of Patent: Mar. 27, 1990

[54] TENNIS RACKET

[75] Inventor: Minoru Yoneyama, Niigata, Japan

[73] Assignee: Yonex Kabushiki Kaisha, Japan

[21] Appl. No.: 164,394

[22] Filed: Mar. 4, 1988

[30] Foreign Application Priority Data

Nov. 17, 1987 [JP] Japan ..... 62-189359[U]

[51] Int. Cl.[4] ..... A63B 49/02

[52] U.S. Cl. ..... 273/73 C; 273/73 F

[58] Field of Search ..... 273/73 C, 73 R, 73 G, 273/73 F

[56] References Cited

U.S. PATENT DOCUMENTS

| | | | |
|---|---|---|---|
| 3,647,211 | 3/1972 | Doessel et al. | 273/73 C |
| 4,177,990 | 12/1979 | Kajiwara | 273/73 C |
| 4,561,655 | 12/1985 | Mortvedt | 273/73 C |
| 4,664,380 | 5/1987 | Kuebler | 273/73 C |

*Primary Examiner*—Edward M. Coven
*Assistant Examiner*—Gary Jackson
*Attorney, Agent, or Firm*—Emrich & Dithmar

[57] ABSTRACT

In a tennis racket whose frame and handle shaft are integrally made of fiber reinforced plastics and the frame defines a strung surface, the frame is so designed that its first thickness "t" in a direction of the strung surface is substantially uniform around the circumference of the frame and its second thickness "T" in a direction perpendicular to the strung surface is gradually varied. The second thickness is maximum at side sections of the frame interposing a sweet spot in the strung surface and is minimum at the top and bottom portions of the frame in such a manner that the maximum thickness is thicker in the range from 35% to 60% than the minimum thickness, which increases a weight per unit length of the frame toward the side sections.

6 Claims, 2 Drawing Sheets

TENNIS RACKET

BACKGROUND OF THE INVENTION

1. Field of the Invention

The present invention relates to a tennis racket of a type in which frame and handle shaft are integrally made of fiber reinforced plastics (hereinafter referred to as "FRP") and the frame is strung with some strings such as a gut. 2. Description of the Prior Art In recent years, tennis rackets having enlarged frames such as so-called large-size racket and mid-size racket have been broadly used. These rackets can provide some advantages in comparison with tennis rackets having conventionally sized frames. In detail these new type rackets provide a high rebounding coefficiency and enlarge their sweet spot. On the contrary, such larger rackets tend to be twisted considerably when an user hits a ball at a point outside of the sweet spot. This tendency is particularly remarkable in the case of FRP-made rackets rather than wood or aluminum-alloy made rackets, because of the small specific gravity of FRP material.

In order to reduce the twisting of rackets, it has been known effective to increase moment of inertia in their frames, and some proposals have been made to attain a relatively large moment of inertia. For example, Japanese Utility Model Applications as laid-open under No. 54-41364 and No. 61-127766 show the tennis rackets in which a metal weight is fixed to a portion of the frame. However, such racket involves new problem. That is, additional component such as the metal weight is not integrally formed with the main component which is used for the frame per se, and thus such different components concentrates mechanical stress on a particular portion so that the frame may be broken in the vicinity of the weight.

Also, Japanese Utility Model Application No. 58-188069 shows another example of improved racket whose frame is added with weight by protruding a part of the internal circumferential surface of the frame radially inwards toward the center of strung surface. However, this racket also causes several problems owing to its frame shape. Such protruded section increases an air resistance and generates turbulent flow which is not ignored, so that energy loss is increased during swing and user may feel unpleasant.

It is therefore an object of the present invention to provide a tennis racket of which frame can have an increased moment of inertia for reducing twisting of the racket, without increasing a surface area of the frame in a plane of a strung surface.

Another object of the present invention is to provide a tennis racket which can effectively transmit an energy to a ball and can provide a good swing feeling.

Still another object of the present invention is to provide a tennis racket improved in its mechanical strength and durability.

A further object of the present invention is to provide a tennis racket which can be manufactured in a simple work.

SUMMARY OF THE INVENTION

According to the present invention, a tennis racket includes a frame for defining a strung surface and a shaft, these frame and shaft being integrally formed of fiber reinforced plastic material. A first thickness of the frame in a direction of plane containing the strung surface is substantially uniform around the circumference of the frame, while a second thickness of the frame in a direction perpendicular to the strung surface is gradually varied. The second thickness is maximum at side sections of said frame interposing a sweet spot in the strung surface and is minimum at the top and bottom portions of the frame in such a manner that the maximum thickness is thicker in the range from 35% to 60% than the minimum thickness, whereby a weight per unit length of the frame increases toward the side sections.

The weight is increased at the side sections of the frame without any protrusion to the strung surface. Therefore, twisting movement of the racket can be effectively reduced while maintaining an air resistance to the racket during a swing motion in the same level as conventional tennis rackets. The increase in thickness of the frame in a direction perpendicular to the strung surface contributes to a stabilization of the swing.

In one embodiment of the invention, the side sections are located at portions slightly below a level of the geometric center of the strung surface. The frame may have a cross section of a substantially oval shape of which minor axis extends in a direction of the first thickness and a longitudinal axis thereof extends in a direction of the second thickness.

Other and further objects, features and advantages of the present invention will appear more fully from the following description taken in connection with the accompanying drawings.

DETAILED DESCRIPTION OF THE INVENTION

Figure 1:
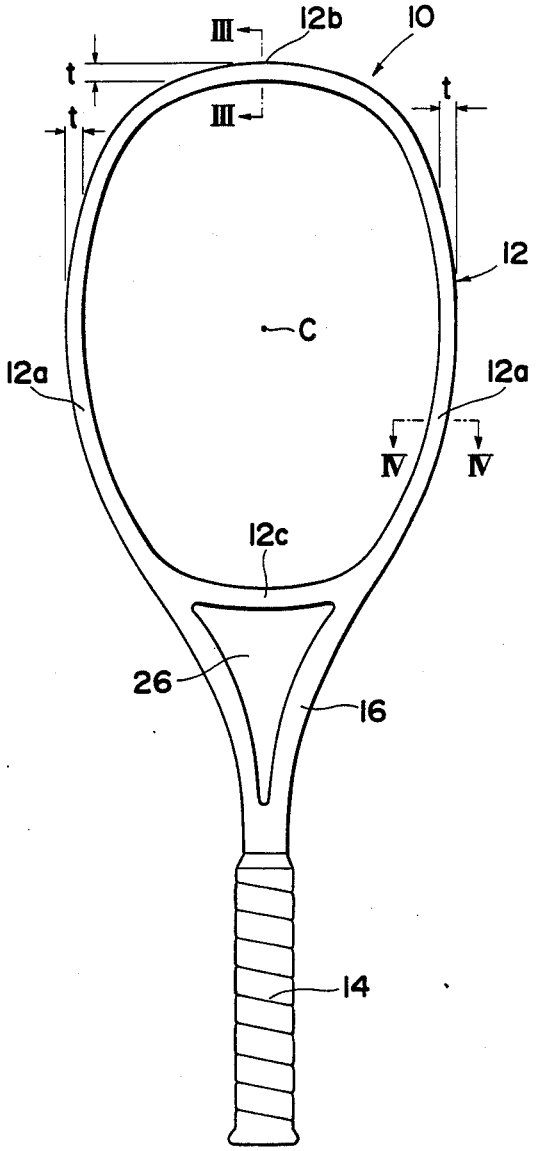
FIG. 1 is an elevational view showing a tennis racket according to an embodiment of the present invention.
Figure 2:
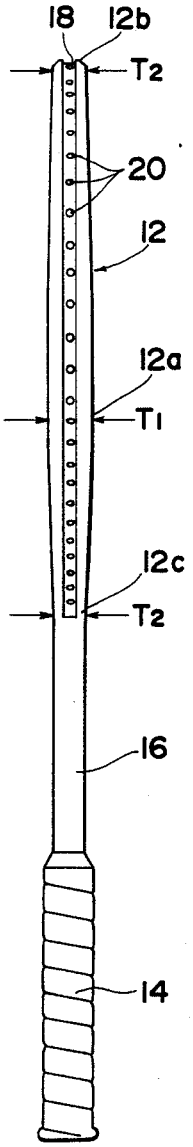
FIG. 2 is a side view showing the tennis racket of FIG. 1.
Figure 3:
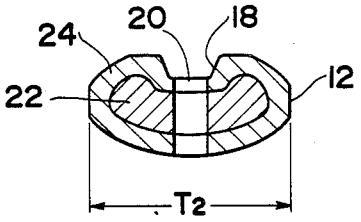
FIG. 3 is a cross sectional view taken along the line III—III in FIG. 1.
Figure 4:
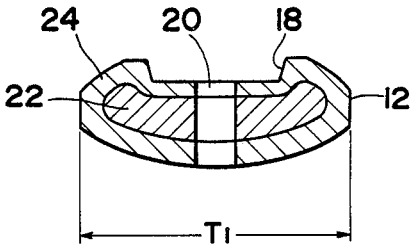
FIG. 4 is a cross sectional view taken along the line IV—IV in FIG. 1.

FIG. 1 shows one preferred embodiment of a tennis racket generally indicated by numeral 10 according to the present invention, which includes a frame 12, a handle or grip 14 defining the lower end of the racket, and a shaft 16 extending between the frame 12 and grip 14. The shaft 16 bifurcates above the grip 14 to define a substantially inverted triangular hollow space 26 therebetween and between the bottom portion 12*c* of the frame 12. The area defined within the frame 12 is adapted to be strung with strings such as guts (not shown) in its vertical and horizontal directions so a to form a ball hitting face. The frame 12 and the shaft 16 are integrally formed by covering a core 22 (see FIGS. 3 and 4) made of foamed resin such as foamed urethane with reinforcing fiber layers 24 impregnated with resin material. Such reinforcing fiber layers 24 usually comprises plural layers and, in this embodiment, long glass fiber are mainly used as reinforcing fibers while external layers may be formed of carbon fibers or other fibers. As shown in FIG. 2, the frame 12 contains a groove 18 in its outer peripheral surface and a plurality of through holes 20 formed in the groove 18. The through holes 20 are used for stringing the gut.

In the illustrated embodiment, the cross section of the frame 12 is substantially formed in an oval shape whose minor axis extends in a plane of the strung surface and longitudinal axis extends in a plane perpendicular to the strung surface. The thickness "t" of the frame 12 along the minor axis is substantially uniform around the circumference of the frame 12 except for the junctions between the shaft 16 and the frame 12 at which the thickness "t" is somewhat increased as shown in FIG. 1. On the other hand, the thickness "T" of the frame 12 along the longitudinal axis is not uniform and is gradually varied around the circumference of the frame 12. Specifically, the thickness "T" becomes maximum at both side sections **12*a*–12*a* which interposes a sweet spot located slightly below the geometric center C of the frame 12, and becomes minimum at the top portion 12*b* and bottom portion 12*c*, these maximum and minimum thicknesses being indicated in FIG. 2 as "T1" and "T2" respectively. The thickness "T" is gradually increased from the top portion 12*b* and bottom portion 12*c* to the side sections 12*a*. As can be seen from FIGS. 3 and 4 which show cross sections at 12*b* and 12*a*, respectively, the wall thickness of the core 22 and the FRP layers 24 is substantially uniform around the frame 12. Therefore, a weight per unit length of the frame 12 is maximum at the side sections 12*a* having the thickness "T1"and gradually decreases toward the top and bottom portions 12*b* and 12*c*** to become minimum at the "T2" thickness portions.

In the illustrated embodiment, the maximum thickness "T1" is set to 30 mm and the minimum thickness "T2" is 21 mm. The maximum thickness "T1" is increased about 43% than the minimum thickness "T". This increasing ratio can be obtained from the following formula:

$$(T1-T2)/T2\times 100 \approx 43\%$$

In the present invention, the increasing ratio can be selected from 35 to 60%. If it is less than 35%, the side sections **12*a*** can not satisfy the weight increment to increase moment of inertia. On the contrary, if the increasing ratio is larger than 60%, center of gravity of the racket will excessively be shifted downwards and thus its weight balance will be lost.

The side sections **12*a*** having the maximum thickness should be so located as to interpose the sweet spot in the strung surface, the sweet spot usually being near the geometric center C or slightly therebelow.

As it could be understood from the foregoing description, the increase in unit weight of the frame toward the side sections thereof achieves the same effect as by adding weight members to the side sections, whereby moment of inertia of the frame is increased to reduce twisting movement of the racket. Further, this advantage can be obtained without providing any protrusion on the inner peripheral surface of the frame and therefore without increasing air resistance during swing motion. The frame thickness is increased only in the direction perpendicular to the strung surface, i.e. in the direction of swing motion, which can ensure a smooth and stable swing of the racket. This will be appreciated by, for example, thinking of swinging a hollow cylindrical member in its axial direction and in an other directions.

Although the present invention has been described with reference to the preferred embodiments thereof, many modifications and alterations may be made within the spirit of the invention.

What is claimed is:

1. A tennis racket including a frame for defining a strung surface and a shaft, said frame and said shaft being integrally formed of fiber reinforced plastic material, wherein a first thickness of said frame in a direction of a plane containing said strung surface is substantially uniform around the circumference of said frame while a second thickness of said frame in a direction perpendicular to said strung surface is gradually varied, and said second thickness is maximum only at side sections of said frame interposing a sweet spot in said strung surface and is gradually reduced to become minimum at the top portion and the bottom portion of said frame in such a manner that the minimum thickness is from 35% to 60% of the maximum thickness, whereby a weight per unit length of said frame is maximum at said side sections of said frame and gradually decreases toward the top and bottom portions of said frame.

2. A tennis racket as claimed in claim 1, wherein said side sections are located at portions slightly below a level of the geometric center of said strung surface.

3. A tennis racket as claimed in claim 1, wherein said frame has a cross section of a substantially oval shape of which minor axis extends in a direction of said first thickness and a longitudinal axis thereof extends in a direction of said second thickness.

4. A tennis racket as claimed in claim 1, wherein said frame comprises a solid core made of foamed plastic material and reinforcing fiber layers covering said core, the thickness of said reinforcing fiber layers being substantially uniform around the circumference of said frame.

5. A tennis racket as claimed in claim 1, wherein said maximum thickness is about 30 mm and said minimum thickness is about 21 mm.

6. A tennis racket including a frame for defining a strung surface and a shaft, said frame and said shaft being integrally formed of fiber reinforced plastic material, wherein a first thickness of said frame in a direction of a plane containing said strung surface is substantially uniform around the circumference of said frame while a second thickness of said frame in a direction perpendicular to said strung surface is gradually varied, increasing the frame thickness only in a direction perpendicular to the plane of the strung surface, said second thickness being maximum only at side sections of said frame interposing a sweet spot in said strung surface and said second thickness being gradually reduced to become minimum at the top portion and the bottom portion of said frame in such a manner that the maximum thickness is thicker in the range from 35% to 60% than the minimum thickness providing an increase in weight per unit length of said frame from the top portion and the bottom portion toward said side sections of said frame.

* * * * *